US008435164B2

(12) United States Patent
VanBuren

(10) Patent No.: US 8,435,164 B2
(45) Date of Patent: May 7, 2013

(54) PERTURBATION APPARATUS AND METHODS FOR PROPRIOCEPTIVE AND REACTIVE BALANCE TRAINING AND THERAPY

(76) Inventor: Jeffrey A. VanBuren, Westerville, OH (US)

( * ) Notice: Subject to any disclaimer, the term of this patent is extended or adjusted under 35 U.S.C. 154(b) by 372 days.

(21) Appl. No.: 12/775,704

(22) Filed: May 7, 2010

(65) Prior Publication Data

US 2010/0285941 A1 Nov. 11, 2010

Related U.S. Application Data

(60) Provisional application No. 61/176,720, filed on May 8, 2009.

(51) Int. Cl.
*A63B 21/00* (2006.01)

(52) U.S. Cl.
USPC ..... 482/145; 482/146

(58) Field of Classification Search ..... 482/146, 482/145
See application file for complete search history.

(56) References Cited

U.S. PATENT DOCUMENTS

| | | | | |
|---|---|---|---|---|
| 1,339,536 | A | 5/1920 | Williams | |
| 2,256,001 | A | 9/1941 | Titus | |
| 3,078,091 | A | 2/1963 | Burke | |
| 3,100,639 | A | 8/1963 | Bonewitz | |
| 3,593,994 | A | 7/1971 | Anbar | |
| 3,612,519 | A | 10/1971 | Larson | |
| 3,784,193 | A * | 1/1974 | Simjian | 482/147 |
| 3,806,116 | A | 4/1974 | Malmberg et al. | |
| 3,911,907 | A | 10/1975 | Smith, Jr. | |
| 4,132,405 | A | 1/1979 | Asher | |
| 4,186,920 | A | 2/1980 | Fiore et al. | |
| 4,252,312 | A | 2/1981 | Dehan | |
| 4,290,601 | A | 9/1981 | Mittelstadt | |
| 4,291,873 | A | 9/1981 | Lee et al. | |
| 4,305,579 | A | 12/1981 | Rice | |
| 4,436,513 | A | 3/1984 | Darby | |
| 4,653,748 | A | 3/1987 | Seel et al. | |
| 4,787,630 | A | 11/1988 | Watson et al. | |
| 4,846,463 | A * | 7/1989 | Kleinnibbelink | 482/146 |
| 4,905,994 | A | 3/1990 | Hartz | |

(Continued)

FOREIGN PATENT DOCUMENTS

GB 2387124 8/2008

OTHER PUBLICATIONS

The Ohio State University "BAPS" informational sheet Aug. 2004.

(Continued)

*Primary Examiner* — Jerome w Donnelly
(74) *Attorney, Agent, or Firm* — Roger A. Gilcrest

(57) ABSTRACT

Disclosed is a portable, manually manipulated perturbation device and methods for proprioceptive and reactive balance training and therapy. The perturbation device is manipulated by a person other than the user to impart linear, rotational or tilting movement, or a combination thereof. The device generally comprises a base, a movable assembly positioned on the base and configured to be stood upon by a user. The movable assembly is movable with respect to the base by a manually manipulated assembly connected to the movable assembly. The method generally comprises the steps of providing a perturbation device, positioning a user on the perturbation device and manipulating the perturbation device by a person other than the user to create the linear, rotational, or tilting movement, or a combination thereof.

17 Claims, 6 Drawing Sheets

U.S. PATENT DOCUMENTS

| | | | | |
|---|---|---|---|---|
| 5,279,533 | A | 1/1994 | Yin et al. | |
| 5,337,757 | A | 8/1994 | Jain et al. | |
| 5,603,334 | A | 2/1997 | Sharp | |
| 5,695,439 | A | 12/1997 | Lin | |
| 5,904,636 | A | 5/1999 | Chen | |
| 6,461,285 | B1 | 10/2002 | Theunissen et al. | |
| D489,423 | S | 5/2004 | Fan et al. | |
| D505,460 | S | 5/2005 | Dalebout et al. | |
| 7,074,167 | B1 * | 7/2006 | Chen | 482/146 |
| D530,374 | S | 10/2006 | Ng | |
| 7,357,767 | B2 | 4/2008 | Tsai | |
| 7,621,861 | B1 | 11/2009 | Kalenber et al. | |
| 2006/0084554 | A1 | 4/2006 | Bement | |

OTHER PUBLICATIONS

"BAPS® Biomechanical Ankle Platform System" http://www.medco-athletics.com/supply/product.asp?Leaf_Id=71060 accessed on the World Wide Web on Sep. 3, 2008.

"Baps® (Biomechanical Ankle Platform System)" http://www.alimed.com/productdetail.asp?fprd=BAPS%26reg; + (Biomechanical+Ankle+Platform+System . . . ) accessed on the World Wide Web on Sep. 3, 2008 p. 1.

"Biomechanical Ankle Platform System (BAPS)/MVP Clinical Package" http://www.rehaboutlet.com/BAPSboard_biomechanical_ankle_platform.htm accessed on the World Wide Web on Oct. 6, 2008 pp. 1-4.

"USurf Surf Your Way to Fitness" http://www.osim.com/product/usurf.aspx?category_id=4071DE2E-7077-4CCE-BD4C-1468CAE026E9 accessed on the World Wide Web on Oct. 6, 2008 pp. 1-3.

"Osim U surf" http://www.alibaba.com/product-free/101451346/0sim_U_surf/showimage.html? accessed on the World Wide Web on Oct. 6, 2008 pp. 1-2.

"Brookstone uSurf Wave-Action Exerciser" http://www.productwiki.com/brookstone-usurf-wave-action-exerciser/ accessed on the World Wide Web on Oct. 6, 2008 pp. 1-4.

"Rehab Supplies" http://www.sammonspreston.com/app.aspx?cmd=get_product&id=76683 accessed on the World Wide Web on Sep. 3, 2008.

Motek Medical "CAREN System" advertisement dated Aug. 21, 2008 pp. 1-2.

Perry Dynamics "PROPRIO® 5000" http://www.proprio5000.com/Products/PROPRIO-5000.aspx accessed on the World Wide Web on May 26, 2010 pp. 1-2.

Fitterfirst "Wobble Board" http://www.fitter1.com/Catalog/Items/WB.aspx accessed on the World Wide Wen on May 26, 2010 pp. 1-2.

* cited by examiner

PERTURBATION APPARATUS AND METHODS FOR PROPRIOCEPTIVE AND REACTIVE BALANCE TRAINING AND THERAPY

CROSS-REFERENCE TO RELATED APPLICATIONS

This application claims the benefit of U.S. Provisional Application No. 61/176,720, filed May 8, 2009, which is hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to a portable, perturbation device and methods for proprioceptive and reactive balance training and therapy.

2. Description of the Related Art

People of all ages receive musculoskeletal injuries when muscles of the foot, ankle, knee and hip do not respond appropriately or quickly enough to stop the motion of the body, or of a particular joint, to prevent injury. Injuries to the lower extremities, such as a foot, ankle, knee, or hip, are among the most common and costly in our society. For example, ankle sprains numbered in excess of 9 million in the U.S. in 2008 and accounted for approximately 20% of all sports injuries. This seemingly simple medical issue generates an estimated $9 billion in office visits, treatment and lost productivity annually in the U.S.

Clinical evidence suggests that "functional mobilization," or proprioceptive and reactive balance training generates better outcomes than the alternative treatment approaches, such as conventional physical therapy, immobilization and therapeutic ultrasound. Proprioception is defined as "the unconscious perception of movement and spatial orientation arising from stimuli within the body itself." Reactive balance is a person's ability to respond to a perturbation or unexpected disturbance and maintain their balance. Proprioceptive and reactive balance training can increase a person's endurance, coordination, and proprioception of the foot, ankle, knee and hip muscles. This can be particularly valuable for high level athletes and the elderly who need to rehabilitate an injured joint or wish to prevent future injury. It also has the potential to reduce costs associated with occupational injuries.

Injury prevention via lower extremity proprioceptive and reactive balance training may save society hundreds of millions of dollars in treatment costs and lost productivity. The implications are even greater when one considers the full impact of preventing falls in populations at risk, such as the elderly. Furthermore, perturbation training can generate cost savings in rehabilitation. Proprioceptive training may accelerate return to work by 5 days and return to sports by 9 days. This could save the general U.S. workforce millions of dollars per year and have dramatic financial implications for highly paid professional athletes and performers who rely on their ability to move.

Currently available devices for proprioceptive training do not offer the necessary complexity of motion required for effective proprioceptive training. They typically provide only one type of movement (e.g., lateral or rotational). Furthermore, they do not effectively challenge the patient with the unexpected movement, or perturbation, that is so often the root cause of injury. Rather, the movement of these devices is generated by the patient or generated in a machine-driven, short, repeating pattern. See, e.g., U.S. Pat. No. 5,904,636.

For example, one such commercially available device is sold under the trade name "Biomechanical Ankle Platform System (BAPS)." The system includes a platform and a series of pivot balls that are attached to the bottom of the platform. In operation, the user selects one or more pivot balls to attach to the platform and then the user performs exercises on the platform. All movement of the device is, thus, generated by the user. See also, U.S. Pat. Nos. 4,653,748; and 7,621,861. Devices of this type do not address the need for the user to respond to unexpected motion or perturbation which, as noted above, is often the cause of injury. A number of patents disclose rotational devices including elastic handles for the user to pull for exercising the arms and providing a more rigorous workout. These devices suffer from the same disadvantage that the user controls the motion of the device. See, e.g., U.S. Pat. Nos. 3,593,994; 6,461.285; 4,787.630; 4332.405; and 5,279.533.

Another disadvantage of several existing designs is that they include relatively bulky frames for the user to hold on to while performing the exercises. In this regard, see U.S. Pat. Nos. 4,305,579; 5,337,757; 5,695,439; and 7,621,861. A number of devices also are limited in their range of motion because they are designed to mimic a given activity, such as surfing, skiing, sail boarding and skateboarding. See, U.S. Pat. Nos. 5,904,636; 4,252,312; 4,436,513; 7,357,767; and U.S. Pat. No. D530,374.

In view of the disadvantages of existing devices, a need exists for more effective proprioceptive training that provides complexity of movement and challenges the patient with unexpected movement.

BRIEF SUMMARY OF THE INVENTION

The present invention addresses perturbation apparatus and methods that provide desired complexity of motion while challenging a user with unexpected motion. The apparatus generally comprises a portable, manually manipulated perturbation training and therapy device. The device includes a generally stationary base, a movable assembly within the base on which the user stands, and a manually manipulated assembly connected to the movable assembly and employed by a person other than the user to effect movement of the movable assembly. Such movement may be linear, rotational, or linear and rotational. An optional user configurable attachment assembly may be provided to change the angle, acceleration rate, speed, direction and timing of the movement challenges posed to the user by the device. The assembly may include, for example, a platform to which are fastened one or more hemispherical attachments.

Generally, the method of the invention comprises the steps of providing a manually manipulated perturbation device, positioning a user on the device and manipulating the device by a person other than the user to effect linear, rotational or tilting movement or any combination thereof.

DETAILED DESCRIPTION OF THE INVENTION

The present invention provides an improved device and methods for conducting therapy for ankle, knee and hip stability and range of motion, as well as for the vestibular system. One of the central advantages of the manually manipulated perturbation device, referred to as a therapeutic rolling platform system, is its ability to offer users and therapists a training experience that is more effective than those that can be achieved through use of products currently available on the market. Specifically, the device provides the ability to manually manipulate the angle, acceleration rate, speed, direction and timing of the perturbations posed to the user by the device. It allows for simultaneous provision of rotational and linear perturbation challenges in unique combinations. The device also enables adjustment of the range of movement, so as to optimize safety and efficacy for the individual needs of each user. The device also is relatively lightweight and portable so that it may easily be moved and transported, for example, by a therapist.

Figure 1:
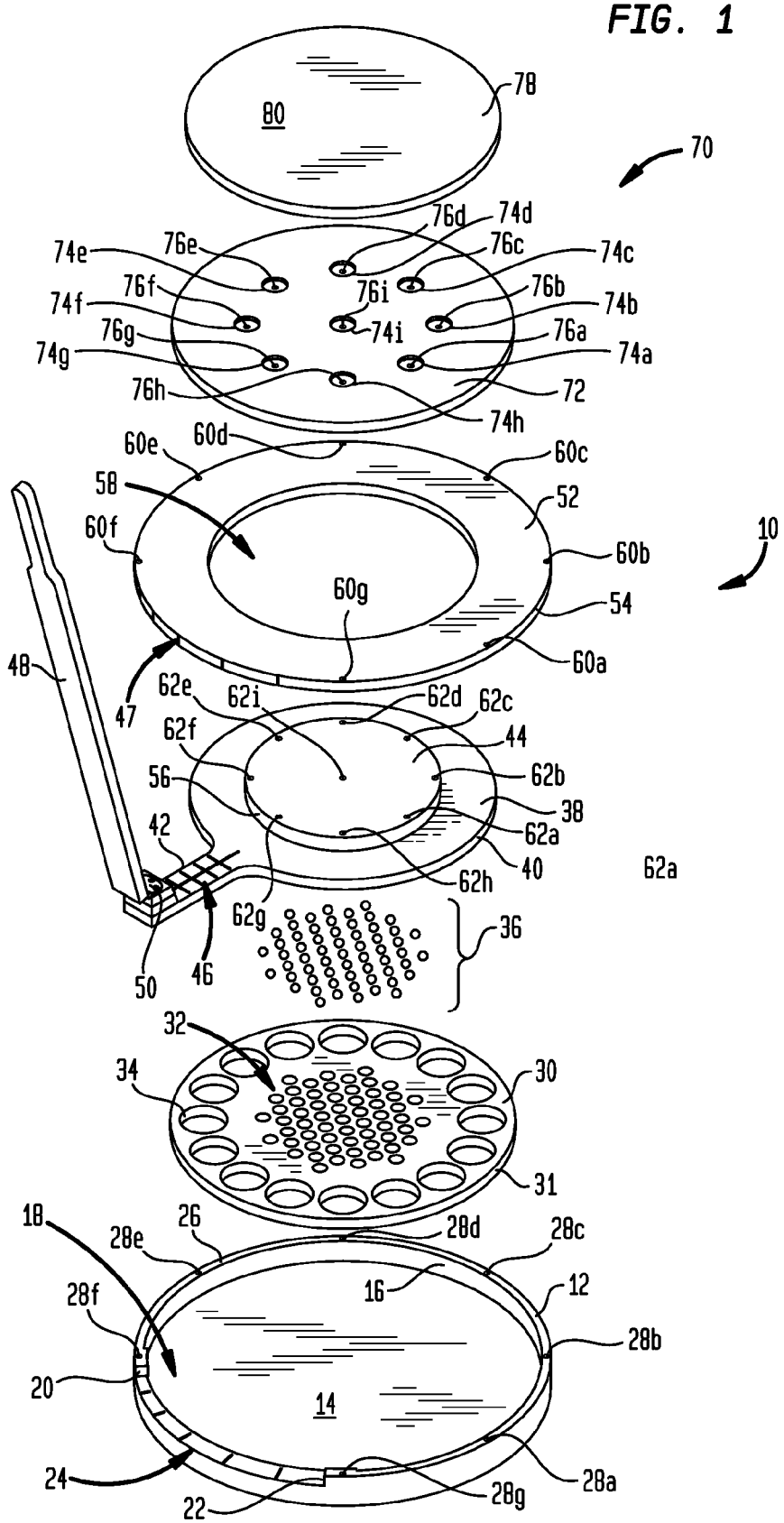
FIG. 1 is an exploded view of one embodiment of the perturbation device of the invention.

FIG. 1 illustrates one embodiment of the perturbation device for proprioceptive and reactive balance training and therapy, shown generally at 10, which provides the above-described advantages. After describing the individual components, the assembly of the device will be discussed in greater detail. Starting at the bottom of the figure and moving upward, perturbation device 10 is seen to include a base 12 including a generally circular disk having a bottom surface (not-shown) that rests on the floor and an upper surface 14. A sidewall, 16, is seen to partially circumscribe the disk of base 12 to form a cavity shown generally at 18. Sidewall 16 terminates at edges, 20 and 22. Base 12 also is seen to include a slot, 24, extending between edges 20 and 22. Base 12 may be formed from any material that provides the structural integrity needed to support a user's weight, such as wood, metal, polymeric material, and the like, or any combination thereof. The material of base 12 also should be selected to provide for smooth spherical ball rolling as will be described below. Sidewall 16 includes an upper edge, 26, bearing a plurality of threaded fastening components, 28*a-f*.

Shown above base 12 is a first or bearing zoning plate, 30. Zoning plate 30 has a given thickness 31 and includes a plurality of apertures indicated generally at 32, which are located in a given geometrical configuration and extend through plate 30. This configuration is for illustrative purposes only as the number and arrangement of these apertures may vary. Portability of device 10 is enhanced by the inclusion of weight reduction openings, sixteen of which are located about the edge of zoning plate 30. One of the weight reduction openings is shown at 34. Above zoning plate 30 is a plurality of ball bearings 36. Each of the ball bearings is configured to fit within one of the apertures, 32. Each of the apertures 32 has a diameter greater than that of its corresponding ball hearing 36 so that zoning plate 30 is linearly movable with respect to base 12.

Looking to the next component, device 10 includes a generally paddle-shaped foot platform, 38, seen to have a circular first portion, 40, and a rectangular portion, 42. Integrally formed with and in the center of portion 40 is a circular raised platform, 44. Platform 44 includes a plurality of threaded connectors, 62*a-i*. Rectangular portion 42 is seen to include a visual cueing system. In this embodiment, device 10 also includes a visual cueing system, described in greater detail below, which includes a series indicators shown generally at 46 on rectangular portion 42 and along the edge of cover 52 as shown generally at 47. Attached to portion 42 is a handle, 48, connected by a conventional hinge, 50. Above foot platform 38 is a cover, 52. Cover 52 is seen to include an aperture, shown generally at 58. Cover 52 has a given thickness, 54 and raised platform 44 has a given thickness, 56. The thickness of cover 54 is less than that of platform thickness 56 so that when assembled platform 44 extends through aperture 58 to slightly protrude above cover 52. A plurality of through holes, 60*a-f*, are provided about the circumference of cover 52 to enable cover 52 to be fastened to base 12.

Figure 5:
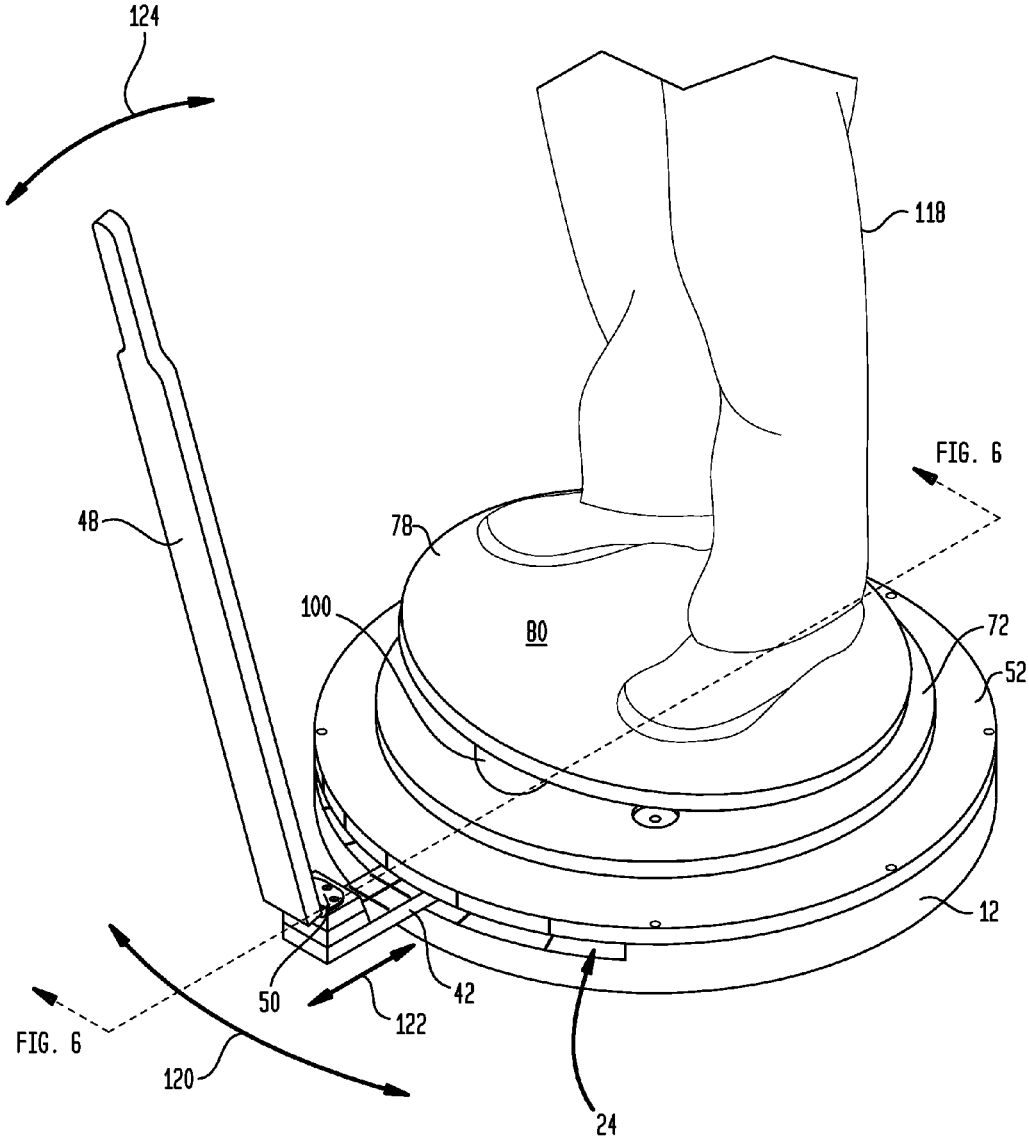
FIG. 5 is a perspective view of the assembled embodiment of FIG. 1 showing a user standing atop the wobble board and illustrating manual manipulation of the device.

Base 12, zoning plate 30, ball bearings 36, foot platform 38, and cover 52 comprise the main components of device 10. Device 10 is assembled as illustrated in FIG. 5 by positioning base 12 on the floor and inserting bearing zoning plate 30 in cavity 18 of base 12. Ball bearings 36 then are positioned within apertures 32 of zoning plate 30. Foot platform 38 then is positioned atop bearings 32 with rectangular portion 42 extending through slot 24 of base 12. Cover 52 is positioned atop foot platform 38 with platform 56 extending through aperture 58. Connectors, such as conventional screws (FIG. 6), are inserted into through holes 60*a-f* and fastened to corresponding threaded connectors 28*a-f* to fasten cover 52 to base 12.

Figure 2:
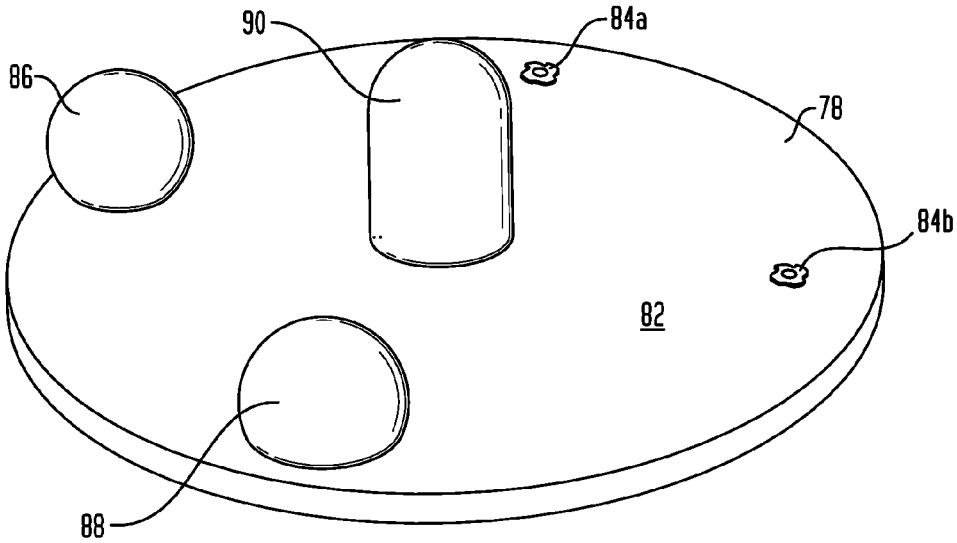
FIG. 2 is a bottom perspective view of a wobble board to which are fastened two hemispherical attachments and an elongated hemispherical attachment.
Figure 3:
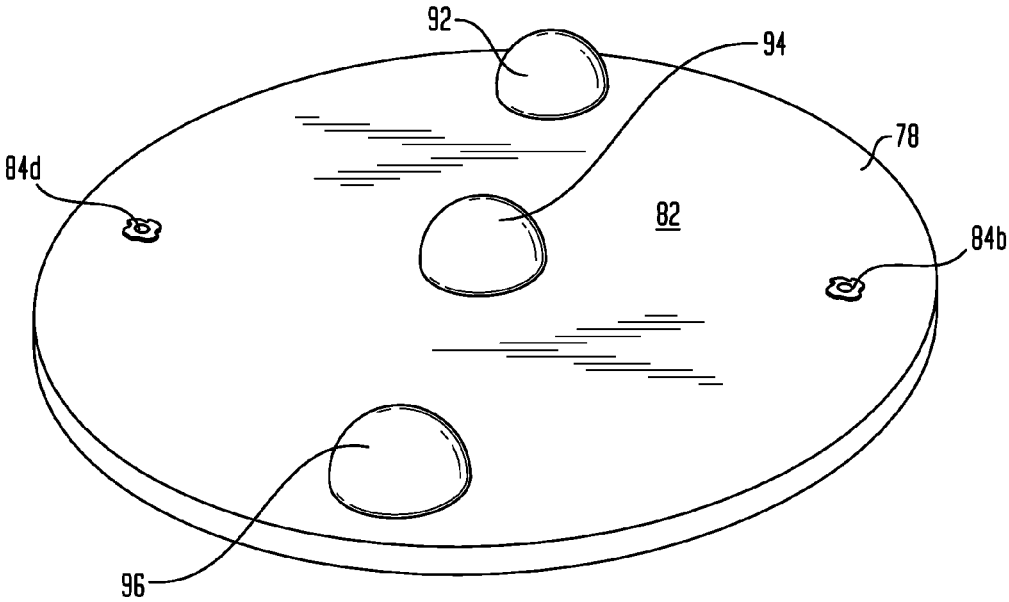
FIG. 3 is a bottom perspective view of the wobble board of FIG. 3 to which are fastened a different configuration of three hemispherical attachments.
Figure 4:
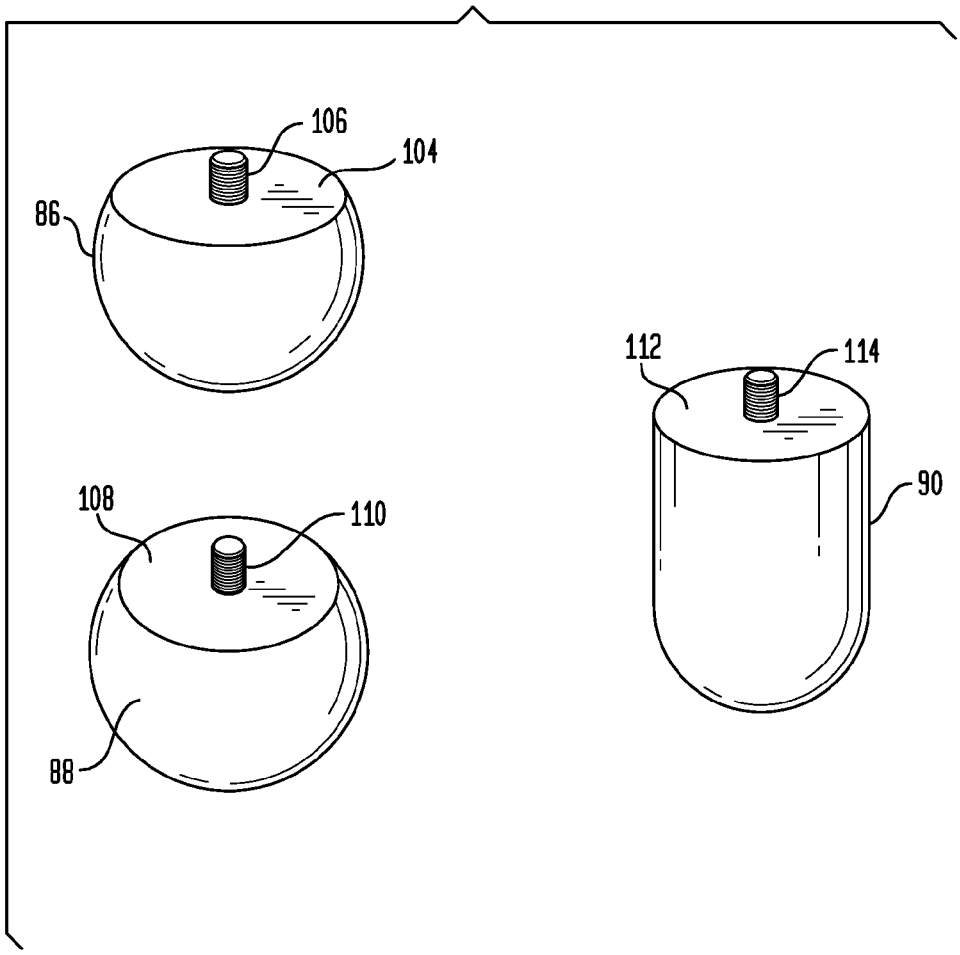
FIG. 4 is a perspective view of the three exemplary hemispherical attachments shown in FIG. 2.

FIGS. 1-4 illustrate an optional user configurable attachment assembly, shown generally at 70 in FIG. 1. Throughout the application, previously identified components retain their prior numeration. Assembly 70 includes a positioning plate, 72. Positioning plate 72 includes a plurality of nine apertures, 74*a*-I, and nine through holes, 76*a-i*. Screws may be inserted into through holes 76*a-i* and connected to corresponding threaded components 62*a-i* to removably fasten positioning plate 72 to platform 44. Assembly 70 also includes a wobble board, 78, having an upper surface, 80, and a bottom surface, 82 (FIGS. 2 and 3). Assembly 70 also includes a series of attachments that vary in size and shape. Several exemplary attachments are illustrated in FIGS. 2-4. Looking to FIG. 2, bottom surface 82 of wobble hoard 78 is seen to include a plurality of first connector components, 84*a-e*, two of which, 84*a* and 84*b*, may be seen in FIG. 2. Three hemispherical attachments are shown at 86, 88 and 90.

Looking briefly to FIG. 4, it may be seen that although each of the hemispherical attachments has a different shape, all of them have a generally horizontal surface configured to be in abutting engagement with bottom surface 82 when the attachments are fastened to wobble board 78. Each attachment also includes a connector component, such as a conventional screw, extending from the bottom of the attachment to be inserted within one of the connector components 84. For example, attachment 86 includes a surface, 104, bearing a screw, 106. Attachment 88 includes a surface, 108, bearing a screw, 110. In like fashion, attachment 90 includes a surface, 112, bearing a screw, 114. The fastening system of device 10 and assembly 70 as shown employ screws and threaded components. However, any suitable means for fastening the components together may be used.

Looking back, FIG. 3 shows wobble board 78 with a different selection of attachments, 92, 94, and 96, fastened to connectors 84*a*, 84*e*, and 84*c*, respectively. Attachments 92, 94 and 96 are seen to be of different sizes and shapes than attachments 86, 88 and 90, but as noted above, each has a generally horizontal bottom surface and a curved surface. The selection of the hemispherical attachments may be made to modify the angle of the wobble board from horizontal or to change the complexity of the challenge to the user's stability. For example, the height of the hemispherical attachments may be the same, as in FIG. 3 or different, as in FIG. 2, to limit or give more motion to the ankle as desired.

Returning to FIG. 1, assembly 70 is placed atop positioning plate 72. The locations of the connector components 84 correspond with the locations of apertures 74 on positioning plate 72 so that when wobble board 78 is positioned on positioning plate 72, the attachments will rest in corresponding apertures 74. With this configuration, wobble board 78 will rotate about the selected hemispherical attachments but wobble board 78 will not roll off positioning plate 72. Prior to use, the desired hemispherical attachments are selected and fastened to wobble plate 78.

As will be well-understood by one of ordinary skill in the art, all of the components of device 10 and assembly 70 may be formed from wood, metal, polymeric material, and the like, or any combination thereof taking into account structural integrity and durability. As will also be well-understood, the various components may be formed having different sizes depending on the user and the training and therapy exercises to be performed. As one example, the disk of base 30 may have a diameter of about 30 inches with a thickness of about one-half inch. Bearing zoning plate 30 may be about 26 inches in diameter with a thickness of about one-half inch. The apertures in bearing plate 30 may be about one and one-half inches in diameter. Bearings 36 may be about three-quarters of an inch in diameter. In this embodiment, apertures 32 are all of the same diameter. Ball hearings 36 also are all the same diameter. It will be appreciated that the invention contemplates that the diameter of the apertures and ball bearings may vary with respect to one another so long as the diameter of each zoning plate aperture is greater than the diameter of its corresponding ball hearing. The first portion of foot platform 38 may have a diameter of about 23 and one-half inches and a thickness of about three-quarters of an inch. Rectangular portion 42 may extending outwardly from foot platform 48 about 8 inches. Raised platform 44 may have a diameter of about 15 inches and a thickness of about three-quarters of an inch. Cover plate 52 may have a diameter of about 30 inches and a thickness of about one-half inch. Aperture 58 may have a diameter of about 20 inches. Looking to assembly 70, wobble board 78 may have a diameter of about 17 and one-half inches and a thickness of about three-quarters of an inch.

Figure 6:
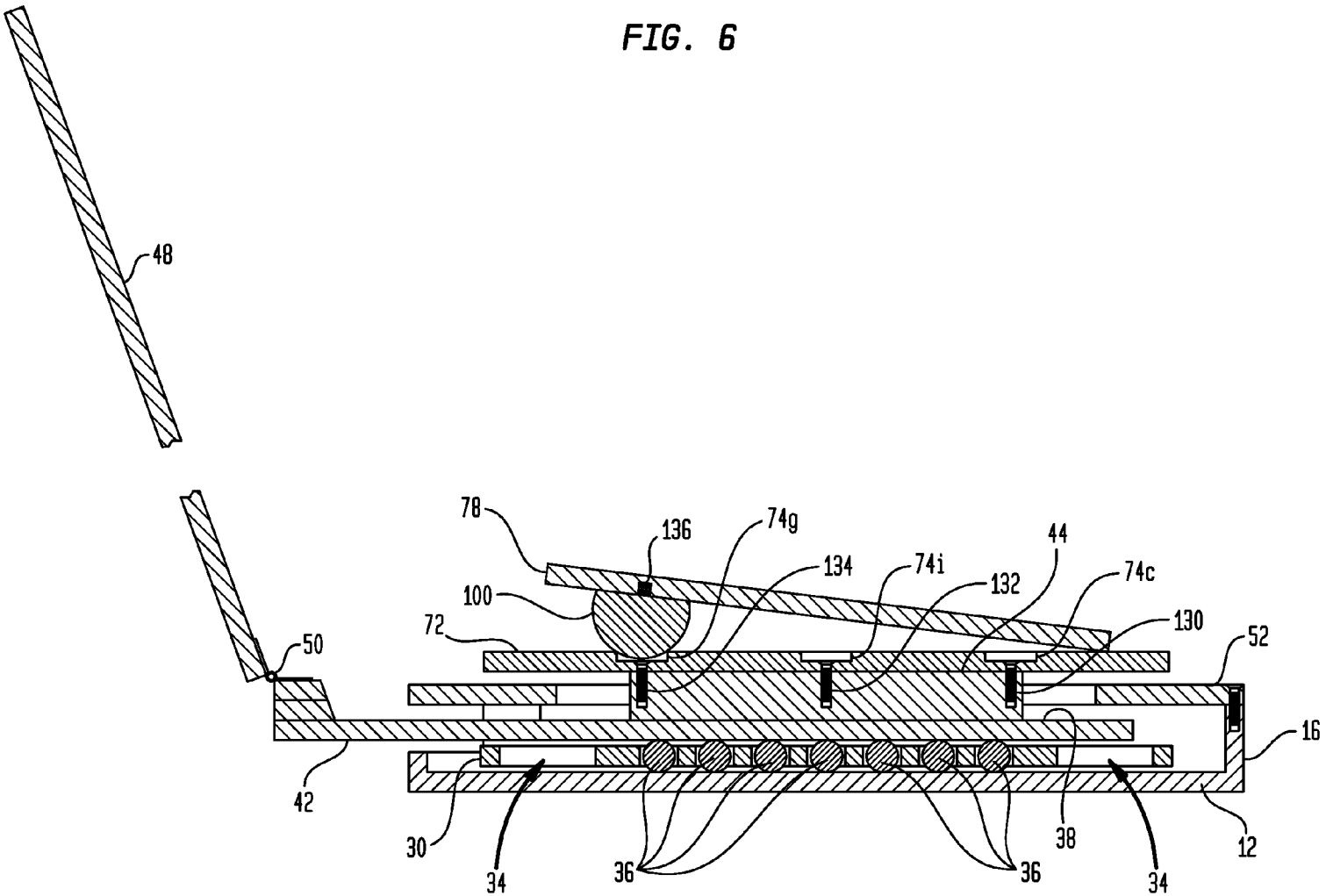
FIG. 6 is a cross-sectional view taken through the plane 5-5 in FIG. 4.

Turning to FIG. 5, perturbation device 10 is shown in its assembled form with user configurable attachment assembly 70 positioned atop it. In this embodiment, one hemispherical attachment, 100, has been selected and connected to wobble board 78. Looking momentarily to the next figure. FIG. 6 shows a cross-sectional view of FIG. 5 taken through the plane 5-5. In addition to the components previously described, this FIG. 6 also shows the fastening system, in this case screws, holding the various components together. Screws 130, 132 and 134 are inserted into through holes 76*c*, 76*d*, and 76*e*, respectively, to connect positioning plate 72 to platform 44. Screw 136 is seen to secure attachment 100 to wobble plate 78. Finally, screw 138 is shown securing cover 52 to base 12. FIG. 6 also illustrates the rotational movement of wobble board 78. While platform 44 generally is rotatable in a single plane, wobble board 78 tilts about hemispherical attachment 100.

Looking again to FIG. 5, a user, 118, such as a therapist's client or patient, is positioned standing on upper surface 80 of wobble board 78. A person other than the user, such as the therapist, will grasp handle 48 and move it back and forth within slot 24. For example, handle 48 may be used to rotate paddle portion 42, and, thus, foot platform 38, back and forth as indicated by bi-directional arrow 120. As foot platform 38 moves, it simultaneously imparts movement to wobble board 78, which will rotate about attachment 100. User 118 must respond to the random motion that he or she did not create or expect. The therapist also can sequentially or simultaneously move handle 48 inwardly and outwardly, as indicated by bi-directional arrow 122, to provide linear movement of foot platform 38. This linear movement is possible because the size of apertures 32 are larger than ball bearings 36 and because zoning plate 30 is of smaller diametric extent than cavity 18 as described in connection with FIG. 1. If desired, linear movement only may be imparted to the user by removing assembly 70 and having user 118 stand directly atop plate 72. Because handle 48 includes hinge 50, it may be maneuvered as indicated by bi-directional arrow 124 to facilitate movement within slot 24.

Using the device 10 and optional assembly 72, the therapist may provide effective, real-time user-customized proprioceptive training to the user. The user may stand in a single or double leg stance front to back or side to side for the purpose of therapeutic training to the lower extremity and vestibular systems. Using handle 48, the therapist can manually manipulate the angle, acceleration rate, speed, direction and timing of the movement challenges posed to the user by the device. It allows for simultaneous provision of rotational and linear movement challenges in unique combinations. Through selection of the appropriate attachments by the therapist, the device also enables adjustment of the range of movement, so as to optimize safety and efficacy for the individual needs of each user.

In addition to being useful as a perturbation training and therapy device, the apparatus of the invention also has utility as a diagnostic device. Specifically, the therapist can use perturbation device 10 and assembly 70 to monitor changes in the patient's proprioception and reactive balance. Looking to FIG. 1, the visual cueing system is seen to include spaced apart generally horizontal indicators along rectangular portion 42, which may be used to measure linear movement. A generally vertical indicator along rectangular component 42 may be used in combination with the indicators provided about the edge of cover 52 to measure the rotational movement. The horizontal indicators and vertical indicator are shown generally at 46, while the generally vertical indicators on cover 52 are shown generally at 47. Using the visual cueing system, the therapist can measure and track the range of motion with which the patient is being challenged. By evaluating the patient's ability to remain stable while device 10 is in motion over a carefully monitored range of linear distance and rotation, the therapist can assess the extent of injury, progress in therapy, and objectively determine the appropriate time for return to sports or work.

Figure 7:
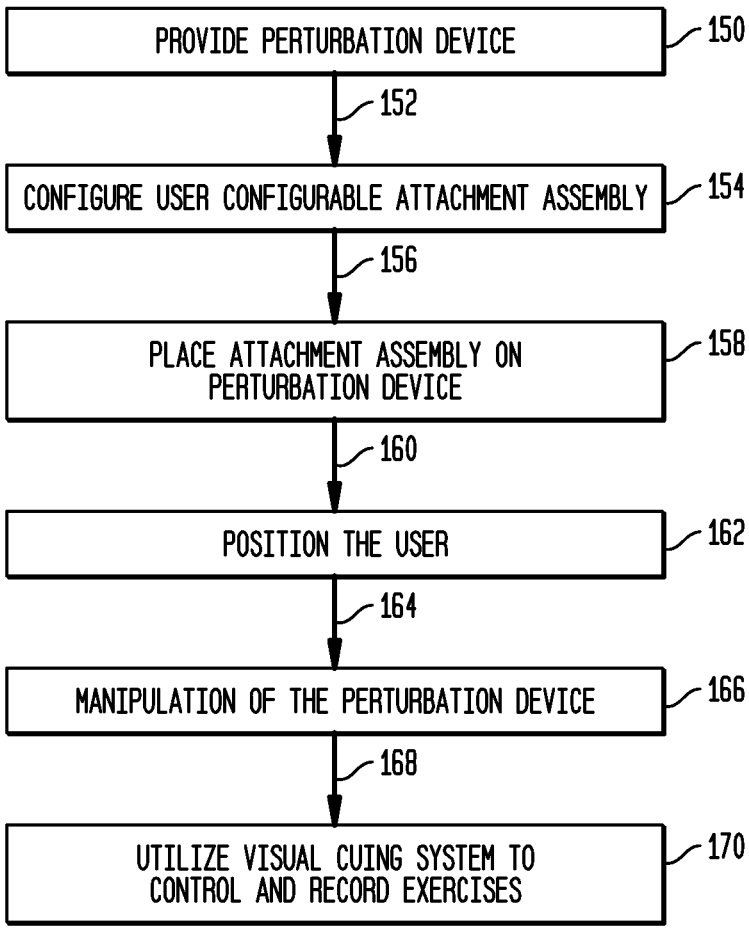
FIG. 7 is a block diagram illustrating methods for providing proprioceptive and reactive balance training and therapy.

FIG. 7 describes the methods of the invention. The first step indicated at block 150 comprises providing a perturbation device for proprioceptive and reactive balance training and therapy, such as that described above in FIGS. 1-6. Components of device 10 and user configurable attachment assembly 70 are referenced hereinafter to assist in understanding the inventive methods but such reference is for illustrative purposes only as the methods may be performed with other embodiments of the disclosed invention. The method continues as indicated by arrow 152 to the step 154 of configuring the user configurable attachment assembly 70. The assembly is configured for a given user by selecting the appropriate attachments and fastening them to the wobble board 78. The selection of attachments may be done by the user or another person, such as a therapist. The method continues as indicated by arrow 156 to the next step 158 which comprises placing the user configurable attachment assembly atop the positioning plate with the selected attachment(s) positioned within the aperture(s) of the positioning plate as described and shown in FIGS. 1-6. Steps 154 and 158 are optional as the perturbation device may be used without assembly 70. The next step indicated by arrow 160 and block 162 involves positioning the user. If the user configurable attachment assembly 70 is employed, then the user is positioned atop the wobble board 78. If not, then the user is positioned atop plate 72. Moving to step 166 as indicated by arrow 164, after the user is positioned, a person other than the user manipulates the proprioceptive training device to impart linear or rotational movement, or a combination thereof. The person manipulating the device may be anyone other than the user, although clearly it is advantageous for the person to be a therapist or other trained health professional. The method also includes the step as indicated at block 170 and arrow 168 of utilizing a visual cueing system, such as that described above. Using the indicators, the person manipulating the device may control the extent of linear and rotational movement imparted to the device by moving handle 48, as indicated by the bi-directional arrows 120 and 122, between particular indicators. Thus, a record of the exercises performed may be preserved for documentary and diagnostic purposes.

The following description is presented to enable any person skilled in the art to make and use the proprioceptive training apparatus and methods in accordance with embodiments of the invention. Various modifications to the preferred embodiments will be readily apparent to those skilled in the art, and the generic principles defined herein may be applied to other embodiments and applications without departing from the spirit and scope of the invention. Moreover, in the following description, numerous details are set forth for the purpose of explanation. However, one of ordinary skill in the art will realize that the invention might be practiced without the use of these specific details. Thus, the present invention is not intended to be limited to the embodiments shown, but is to be accorded the widest scope consistent with the principles and features disclosed herein.

The invention claimed is:

1. A portable, manually manipulated perturbation device for proprioceptive and reactive balance training and therapy, comprising:

(a) a generally stationary base having a base upper surface and a base sidewall extending upwardly from the outer edge of said base upper surface and defining a cavity, said base sidewall including a slot;

(b) a movable assembly configured to be positioned on said base upper surface within said cavity and having a generally horizontal surface configured to be stood upon by a user, said movable assembly being movable with respect to said base, said movable assembly comprising:

i. a first plate having a plurality of first plate apertures and being positioned within said base cavity, ii. a plurality of ball bearings positioned within said plurality of first plate apertures, iii. an apparatus having a first portion with an upper surface and lower surface and a second portion, said first portion including a raised platform of a given height and wherein said lower surface of said first portion rests atop said plurality of ball bearings and said second portion extends through said slot; and (c) a manually manipulated assembly connected to said movable assembly and configured for manual manipulation by a person other than the user to effect movement of said movable assembly, said manually manipulated assembly comprising a handle connected to said second portion and is configured to be movable within said slot.

2. The portable, manually manipulated perturbation device for proprioceptive and reactive balance training and therapy of claim 1, wherein said handle is configured to be generally rigid and said handle is hingedly connected to said second portion.

3. The portable, manually manipulated perturbation device for proprioceptive and reactive balance training and therapy of claim 1, further comprising a visual cueing system.

4. The portable, manually manipulated perturbation device for proprioceptive and reactive balance training and therapy of claim 1, wherein said base, movable assembly and manually manipulated assembly are formed of one or more of wood, plastic, or metal.

5. The portable, manually manipulated perturbation device for proprioceptive and reactive balance training and therapy of claim 1, further comprising:

(d) a user configurable attachment assembly positionable atop said movable assembly and comprising, i. a generally circular attachment plate, ii. a plurality of hemispherical pieces, iii. a fastening system for selectively, removably attaching one or more of said hemispherical pieces to said attachment plate, and iv. a positioning plate configured to rest atop said movable assembly and including a plurality of apertures in geometric, correspondence with said one or more hemispherical pieces when attached to said attachment plate by said fastening system.

6. The portable, manually manipulated perturbation device for proprioceptive and reactive balance training and therapy of claim 5, wherein said positioning plate is removably secured to said movable assembly and said cover plate is removably secured to said base.

7. The portable, manually manipulated perturbation device for proprioceptive and reactive balance training and therapy of claim 5, wherein said attachment plate, hemispherical pieces, and positioning plate are formed of one or more of wood, plastic, or metal.

8. The portable, manually manipulated perturbation device for proprioceptive and reactive balance training and therapy of claim 1, wherein said first plate includes one or more weight reduction openings.

9. The portable, manually manipulated perturbation device for proprioceptive and reactive balance training and therapy, comprising:

(a) a generally stationary circular base having a base upper surface, and a base sidewall extending upwardly from the outer edge of said base upper surface and circumscribing a given portion of said base to define a slot and a base cavity;

(b) a generally circular first plate having a plate upper surface and a plate lower surface, and a plurality of first plate apertures, said first plate being positioned within said base cavity;

(c) a plurality of ball bearings positioned within said plurality of first plate apertures;

(d) a generally paddle-shaped apparatus having a first paddle portion being generally circular with an upper surface and lower surface and a second paddle portion being generally rectangular, said first paddle portion including a raised platform of a given height and wherein said lower surface of said paddle portion rests atop said plurality of ball bearings and said second paddle portion extends through said slot;

(e) a handle connected to said second paddle portion; and (f) a cover plate having a cover plate aperture and a given cover plate thickness, said cover plate thickness being less than said height of said platform, and said cover plate being configured to rest atop said first paddle upper surface.

10. The portable, manually manipulated perturbation device for proprioceptive and reactive balance training and therapy of claim 9, wherein said handle is configured to be generally rigid and said handle is hingedly connected to said second paddle portion.

11. The portable, manually manipulated perturbation device for proprioceptive and reactive balance training and therapy of claim 9, wherein said first plate includes one or more weight reduction openings.

12. The portable, manually manipulated perturbation device for proprioceptive and reactive balance training and therapy of claim 9, further comprising:

(g) a user configurable attachment system positionable atop said movable assembly and comprising, i. a generally circular attachment plate, ii. a plurality of hemispherical pieces, iii. a fastening system for selectively, removably attaching one or more of said hemispherical pieces to said attachment plate, and iv. a positioning plate configured to rest atop said movable assembly and including a plurality of apertures in geometric correspondence with said one or more hemispherical pieces when attached to said attachment plate by said fastening system.

13. The portable, manually manipulated perturbation device for proprioceptive and reactive balance training and therapy of claim 12, wherein said positioning plate is removably secured to said movable assembly and said cover plate is removably secured to said base.

14. A method for providing proprioceptive and reactive balance training and therapy to a user, comprising the steps of:

(a) providing a manually manipulated perturbation device capable of linear and rotational movement;

(b) providing a user configurable attachment system capable of tilting movement;

(c) configuring said user configurable attachment system for said user;

(d) positioning said user configurable attachment system on said perturbation device;

(e) positioning said user on said user configurable attachment system; and (f) manually manipulating said manually manipulated perturbation device to effect one or more of said linear, rotational and tilting movement.

15. The method of claim 14, wherein:

said step (a) further comprises providing said manually manipulated perturbation training and therapy device, including, i. a generally stationary circular base having a base upper surface, and a base sidewall extending upwardly from the outer edge of said base upper surface and circumscribing a given portion of said base to define a slot and a base cavity;

ii. a generally circular first plate having a plate upper surface and a plate lower surface, and a plurality of first plate apertures, and a plurality of weight reduction openings, said first plate being positioned within said base cavity;

iii. a plurality of ball bearings positioned within said plurality of first plate apertures:

iv. a generally paddle-shaped apparatus having a first paddle portion being generally circular with an upper surface and lower surface and a second paddle portion being generally rectangular, said first paddle portion including a raised platform of a given height and wherein said lower surface of said paddle portion rests atop said plurality of ball bearings and said second paddle portion extends through said slot;

v. a generally rigid handle connected to said second paddle portion; and vi. a cover plate having a cover plate aperture and a given cover plate thickness, said cover plate thickness being less than said height of said platform, and said cover plate being configured to rest atop said first paddle upper surface, and vii. a user configurable attachment system positionable atop said movable assembly and comprising a generally circular attachment plate, a plurality of hemispherical pieces, a fastening system for selectively, removably attaching one or more of said hemispherical pieces to said attachment plate, and a positioning plate configured to rest atop said movable assembly and including a plurality of apertures in geometric correspondence with said one or more hemispherical pieces when attached to said attachment plate by said fastening system; and said step (c) further comprises grasping said handle and moving said handle within said slot to effect said linear, rotational and tilting movement.

16. A portable, manually manipulated perturbation device for proprioceptive and reactive balance training and therapy, comprising:

(a) a generally stationary base having a base upper surface and a base sidewall extending upwardly from the outer edge of said base upper surface and defining a cavity said base sidewall including a slot;

(b) a movable assembly configured to be positioned on said base upper surface within said cavity and having a generally horizontal surface configured to be stood upon by a user, said movable assembly being movable with respect to said base, said movable assembly comprising:

i. a first plate having a plurality of first plate apertures and being positioned within said base cavity, ii. a plurality of ball bearings positioned within said plurality of first plate apertures, iii. an apparatus having a first portion with an upper surface and lower surface and a second portion, said first portion including a raised platform of a given height and wherein said lower surface of said first portion rests atop said plurality of ball bearings and said second portion extends through said slot; and (c) a manually manipulated assembly connected to said movable assembly and configured for manual manipulation by a person other than the user to effect movement of said movable assembly, said manually manipulated assembly comprising a handle connected to said second portion and is configured to be movable within said slot, said being configured to be generally rigid and said handle is hingedly connected to said second portion; and (d) a visual cueing system.

17. The portable, manually manipulated perturbation device for proprioceptive and reactive balance training and therapy of claim 16, further comprising:

(a) a user configurable attachment assembly positionable atop said movable assembly and comprising, i. a generally circular attachment plate, ii. a plurality of hemispherical pieces, iii. a fastening system for selectively, removably attaching one or more of said hemispherical pieces to said attachment plate, and iv. a positioning plate configured to rest atop said movable assembly and including a plurality of apertures in geometric, correspondence with said one or more hemispherical pieces when attached to said attachment plate by said fastening system.

* * * * *